US005778799A

United States Patent [19]

Eyre

[11] Patent Number: 5,778,799

[45] Date of Patent: Jul. 14, 1998

[54] COMPUTER WORK STATION

[75] Inventor: Clarence W. Eyre, Dry Prong, La.

[73] Assignee: Baker Manufacturing Co., Pineville, La.

[21] Appl. No.: 605,801

[22] Filed: Feb. 23, 1996

Related U.S. Application Data

[63] Continuation of Ser. No. 261,051, Jun. 13, 1994, abandoned, which is a continuation-in-part of Ser. No. 956,157, Oct. 5, 1992, Pat. No. 5,685,231.

[51] Int. Cl.[6] ..... A47F 5/12

[52] U.S. Cl. ..... 108/7; 108/10; 108/50.01; 108/147

[58] Field of Search ..... 108/1, 3, 7, 10, 108/9, 147, 50

[56] References Cited

U.S. PATENT DOCUMENTS

| | | | |
|---|---|---|---|
| 544,836 | 8/1895 | Vetter . | |
| 2,541,075 | 2/1951 | Koch . | |
| 2,822,229 | 2/1958 | Carlson . | |
| 2,982,050 | 4/1961 | May | 108/145 X |
| 3,162,317 | 12/1964 | Becker . | |
| 3,213,809 | 10/1965 | Kritske | 108/10 X |
| 3,364,881 | 1/1968 | Kooi . | |
| 3,903,812 | 9/1975 | Cowley . | |
| 3,908,560 | 9/1975 | Horner . | |
| 4,130,069 | 12/1978 | Evans et al. . | |
| 4,440,696 | 4/1984 | Rice et al. . | |
| 4,469,029 | 9/1984 | Ramond | 108/3 |
| 4,474,115 | 10/1984 | Carlton . | |
| 4,550,666 | 11/1985 | Svoboda . | |
| 4,567,835 | 2/1986 | Reese et al. . | |
| 4,637,322 | 1/1987 | Hampshire . | |
| 4,667,605 | 5/1987 | Bastian . | |
| 4,712,653 | 12/1987 | Franklin et al. . | |
| 4,717,112 | 1/1988 | Pirkle . | |
| 4,747,353 | 5/1988 | Watt | 108/147 X |
| 4,751,884 | 6/1988 | Ball . | |
| 4,805,538 | 2/1989 | Fisher et al. . | |
| 4,815,391 | 3/1989 | Lee . | |
| 4,938,441 | 7/1990 | Hannah et al. . | |
| 5,005,492 | 4/1991 | Ogino et al. | 108/145 |
| 5,041,770 | 8/1991 | Seiler et al. . | |
| 5,101,736 | 4/1992 | Bommarito et al. . | |
| 5,131,333 | 7/1992 | Kamsawa et al. . | |
| 5,271,320 | 12/1993 | Reneau | 108/7 X |
| 5,322,025 | 6/1994 | Sherman et al. | 108/147 |
| 5,339,750 | 8/1994 | Smies | 108/147 |
| 5,398,622 | 3/1995 | Lubinskas et al. | 108/3 X |

FOREIGN PATENT DOCUMENTS

| | | |
|---|---|---|
| 813763 | 5/1969 | Canada . |
| 2508294 | 12/1982 | France . |
| 3347296 | 7/1985 | Germany . |
| 3701797 | 8/1988 | Germany . |
| 530491 | 7/1955 | Italy . |
| 99489 | 11/1923 | Switzerland . |
| 441653 | 1/1968 | Switzerland . |
| 657286 | 9/1951 | United Kingdom . |
| 774129 | 5/1957 | United Kingdom . |

*Primary Examiner*—Jose V. Chen

*Attorney, Agent, or Firm*—Pravel, Hewitt, Kimball & Krieger

[57] ABSTRACT

A computer console has a computer monitor platform and a keyboard platform. Movement of a system of support arms for the computer platform is controlled by a pressurized gas cylinder via a control cable extending from the underside of the platform at its front edge. The keyboard platform is mounted by arms secured to an eccentrically mounted elongated cylinder whereby the horizontal position of the keyboard is maintained during movement well below and well above the computer platform, the keyboard platform also mounted for both positive and negative tilt of 8° above and below the horizontal.

18 Claims, 2 Drawing Sheets

COMPUTER WORK STATION

This is a continuation of U.S. Ser. No. 08/261,051, filed Jun. 13, 1994 abd. which is a continuation-in-part of U.S. Ser. No. 07/956,157, filed Oct. 5, 1992, (now U.S. Pat. No. 5,685,231, issued Nov. 11, 1997).

FIELD OF THE INVENTION

The present invention relates to a computer work station and more particularly to a highly flexible easily used work station of relatively simple construction.

BACKGROUND OF THE INVENTION

In accordance with the related application, a main platform for a computer console and/or monitor is supported in vertical guides attached to a base support. The platform is counterweighted to assist movement between upper and lower positions. The counterweight is supported by a chain or the like that passes over a pulley attached to the base support and is attached to a main platform whereby as the main platform is moved up and down the counterweight is moved up and down and assists in such movement. The pulley includes a brake mechanism which is normally engaged so that unless the brake is released the platform remains in whatever position it has been put.

A keyboard platform is suspended from supports for the main platform by a suspension which permits up and down movement in which the platform's upper surface remains parallel to itself at any position between upper and lower extremes.

A charged air cylinder is employed to hold the keyboard platform in any position desired as between upper and lower extremes, the piston being valve operated by a control at the front of the keyboard platform to permit movement thereof.

The keyboard platform may be disposed in either of two angular positions so as to provide a horizontal surface or a surface tilted toward the operator.

OBJECTS OF THE INVENTION

It is an object of the present invention to provide a computer work station having a console platform and a keyboard platform, such station being of relatively simple construction and relatively inexpensive to fabricate and assemble.

It is another object of the present invention to provide a computer work station wherein the console platform is locked in any position between uppermost and lowermost position by gas cylinders.

Another object of the present invention is to adjust the operating platform mechanisms for different weight loads.

Still another object of the present invention is to use a single linkage for support and adjustment of the keyboard platform.

BRIEF DESCRIPTION OF THE PRESENT INVENTION

The computer work station of the present invention includes a console platform supported on a different vertical slide plate adjacent each side of the platform, the slide plates, sliding inside of sidewalls of a cabinet structure of the station.

Each slide plate is supported on a pair of arms each having one end pivotally secured to its associated plate at different vertical locations. The other ends of the arms are pivotally supported by the cabinet, also at different vertical locations. One arm of each pair of arms has extending between the arm and the cabinet a pressurized gas cylinder that assists in the movement of and permits each of these arms to be locked in any position between lowermost and highest permissible positions of the console platform. Control cables for the gas cylinder extend from the cylinders to adjacent knobs located at the leading edge of the platform.

Interconnections of the gas cylinders between the slide plates and the cabinet can be changed to accommodate loads of different weights.

The keyboard platform is suspended by arm 3 welded to and extending from an eccentrically mounted elongated cylinder mounted in the cabinet and to plates located under the keyboard. The keyboard platform is pivotally secured to such plates permitting rotation of the platform in both directions relative to horizontal. A single pressurized gas cylinder extending between the cabinet and one of the arms assists in movement of and locks the keyboard at a location depending upon the control applied to the cylinder from a keyboard control.

The above and other features, objects and advantages of the present invention, together with the best means contemplated by the inventor thereof for carrying out the invention will become more apparent from reading the following description of a preferred embodiment and perusing the associated drawings in which:

DETAILED DESCRIPTION OF THE PRESENT INVENTION

Figure 1:
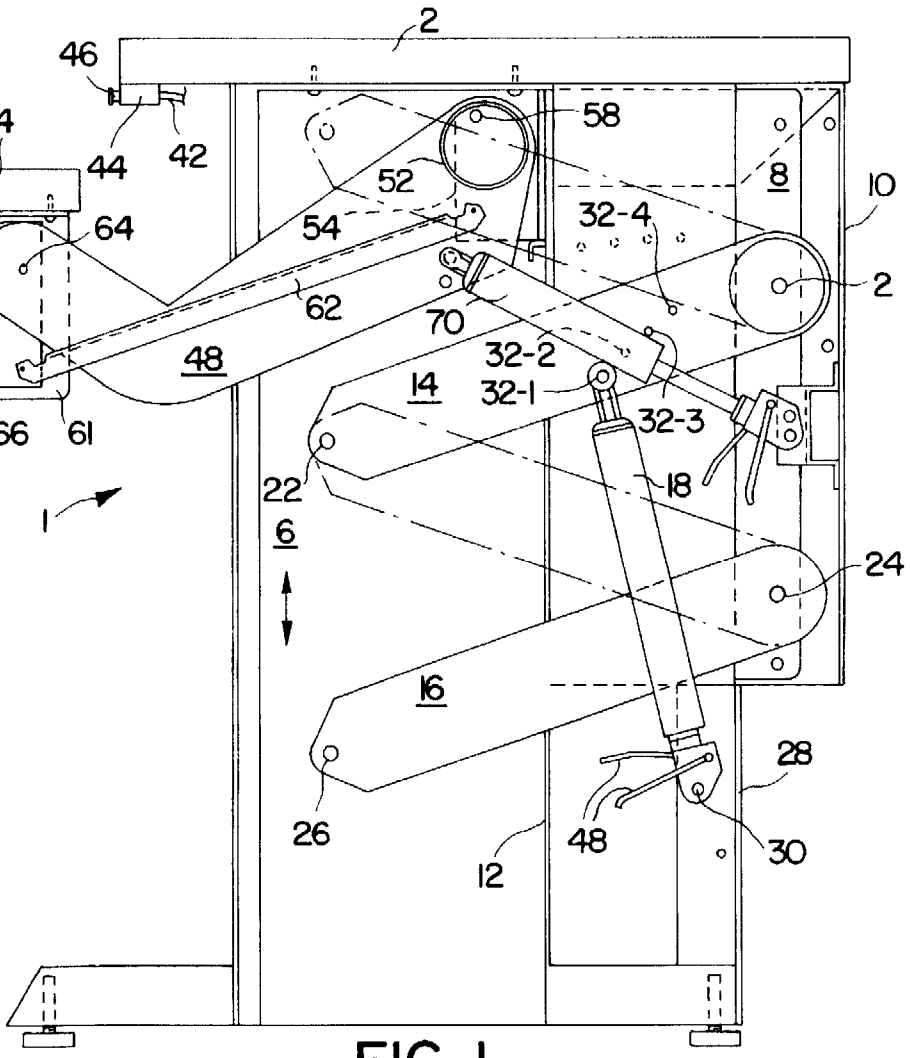
FIG. 1 is a side view in elevation of the mechanism associated with one side only of the console platform and support structure employed to adjust the height of the console platform and of the complete mechanism for controlling the height and angle of the keyboard platform.

Referring now specifically to FIG. 1 of the accompanying drawings there is provided a computer console 1 having a computer or monitor platform 2 and a keyboard platform 4. The monitor platform 2 is supported adjacent its two side ends on vertical slides, bearing reference numeral 6.

The slides 6 are slidably disposed in channels formed in sidewalls 8 of the console 1. The console 1 has a rear wall 10 and a wall 12 disposed parallel to but forward of the wall 10.

The wall 10 as illustrated in FIG. 1, is aligned with the back edge of the platform 2. The region of the sidewalls 8 adjacent backwall 10 each has pivotally connected thereto two vertically spaced arms 14 and 16 which together with pressurized air piston 18 control the vertical height of the platform 2. The arms 14 and 16 are shown in solid lines in the platform down position and in dashed lines in the platform up position. The arm, upper arm, 14 is pivoted to wall 8 at location 2 and to slide 6 at location 22. Lower arm 16 is pivoted to wall 8 at location 24 and to the slide 6 at location 26. The arms 14 are shown in their positions when the platform 2 is in its lowermost position and in the dashed line position when the platform is in its uppermost position. A corresponding arrangement is provided with respect to slide 6.

Figure 3:
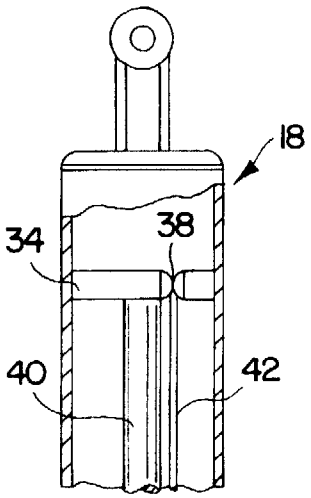
FIG. 3 is a diagrammatic illustration of a piston-cylinder control member employed herein.
Figure 2:
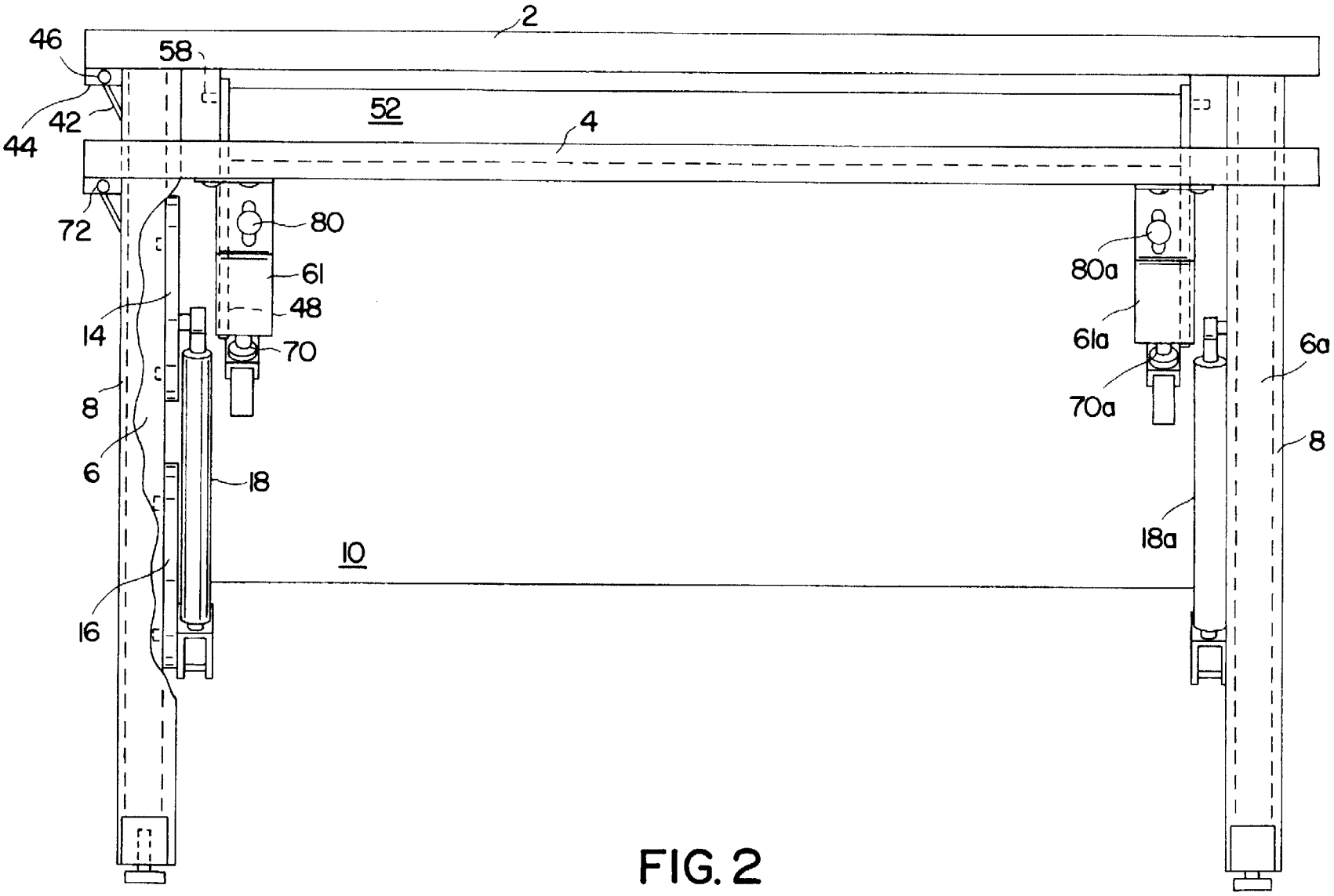
FIG. 2 is a front elevation view of the structure of the invention.

Movement of the arms 14 is controlled by the pressurized cylinder piston 18, and is illustrated diagrammatically in FIG. 3. The piston is manufactured by Suspa, Incorporated. The piston 18 is pivotally connected at 30 at its lower end as illustrated in FIG. 1 to another region of the sidewall 8 adjacent a further region of the backwall of the cabinet designated 28. Upper end of piston 18 is pivotally connected to the arm 14 at any one of four different locations designated 32-1, 32-2, 32-3 and 32-4. The load on the platform determines which of the four holes is used since this connection determines the length of the lever arm acting on the platform.

The cylinder 18 comprises a cylindrical body 34 with a piston 36 having a valve 38 providing controlled communication between the two sides of the piston. The gas pressure on each side of the piston is the same but the force on the upper side of the piston, as viewed in FIG. 3, is greater than on its lower side because of the larger surface area.

With the valve closed, the piston is locked in position and the platform 2 is held in its last set position. With valve open the console platform may be raised or lowered with greater force on the top of the piston helping to extend the piston rod 40. Gravity assists in lowering the platform so that movement in both directions of the platform 2 has a force assisting with movement whereby workers do not have to strain when moving the platform 2.

The cylinder 18 is controlled by a Belsen wire 42 extending from a control box 44 mounted under the platform 2 adjacent its front edge. A knob 46 is connected to the internal wire 48 of the Belsen wire 42 so that when the knob is pulled the valve 38 is opened.

With valve 38 open so that the chambers on the two sides of the piston 36 are in communication with one another, the platform may be moved. When the valve 38 is closed by pushing on knob 46 the platform is locked in position.

The keyboard 4 is supported by dogleg arms 48 and 50 welded to an elongated cylinder 52 that extends between plates 54 and 56. The cylinder is secured by pivot pins 58 and 60 to the plates 54 and 56; the plates being secured to the wall 12. It is to be noted that the cylinder is eccentrically pivoted so as to maintain clearance from the platform 2 regardless of location of the platform above or below platform 2. The ends of the arms 48 and 50 remote from cylinder 52 are pivoted by pivot pins 62 and 64 to plates 66 and 68, respectively, disposed under the platform 4. A link 62 is connected from the plate 54 to plate 66 to provide the necessary stability to the platform 4. Vertical movement of the keyboard both above and below the platform 2 is controlled by a pressurized gas cylinder 70 controlled via a Belsen wire, by a knob 72 supported at the front edge of the platform 4. Two holes are provided in arm 48 for connection of the gas cylinder to accommodate different loads. Control of the gas cylinder is the same as with cylinder 18.

The keyboard platform 4 has plates 61 and 63 secured to the underside of the platform 4 and pivotally secured to the plates 66 and 68 by pivot pins 74. A pin 76 extending from a control member 78 secured to plate 66, extends into a curved slot (not illustrated) in plate 61 and permits the plate 61 to be rotated about pin 74 within limits of the slot. Actual pivoting of the keyboard platform 4 is controlled by knob 80 which is secured to plate 61 and upon rotation of the plate 61 about pivot 74 (upon pulling out on the knob 80) a projection 82 from the knob may be seated in any one of three different slots in the front edge of the member 78. The tilt mechanism provides 8° off horizontal in both directions.

Once given the above disclosure, many other features, modifications and improvements will become apparent to the skilled artisan. Such features, modifications and improvements are, therefore, considered to be a part of this invention, the scope of which is to be determined by the following claims.

what is claimed is:

1. A computer console comprising:

a) a cabinet having sidewalls with vertical channels formed therein and a backwall;

b) a first platform supported by the cabinet for movement into multiple elevational positions;

c) the cabinet including a pair of vertical slides each slide secured to said first platform with each slide disposed in a different one of said channels;

d) a plurality of arms, including at least vertically spaced single upper and lower arms with each of the arms extending between a different sidewall of the cabinet and a different one of said slides;

e) said platform being adjustable into multiple elevational positions by rotation of each of the arms relative to the cabinet; and f) an actuator having first and second end portions, one end portion attached to the cabinet near the back wall, the other end portion attached to an arm for movement therewith.

2. A computer console according to claim 1 further wherein the actuator includes at least one pressurized gas cylinder connected between one of said arms and said cabinet.

3. A computer console according to claim 2 wherein said gas cylinder is a self locking gas cylinder.

4. A computer console comprising:

a first platform;

a cabinet having sidewalls with vertical channels formed therein and backwalls;

a pair of vertical slides each secured to said first platform with each disposed in a different one of said channels, two pairs of arms, each pair having an upper arm and a lower arm extending between sidewalls of the cabinet and a different one of said slides;

means for producing rotation of each said pair of arms relative to the sidewalls whereby to raise and lower said first platform, means for adjusting the first platform to accommodate different weight loads;

said means for adjusting including means for connecting said means for producing rotation at different locations on one of said arms of each of said pair of arms.

5. A computer console according to claim 4 wherein said pair of arms are parallel to one another and have one end of each pivotally secured to one of said sidewalls at vertically spaced locations and the other ends pivotally secured to an adjacent slide, at least one gas cylinder connected to one of said arms, the point of connection of said gas cylinder to said arm being variable to accommodate different loads.

6. A computer console comprising:

a first platform;

a cabinet having sidewalls with vertical channels formed therein and backwalls;

a pair of vertical slides each secured to said first platform with each disposed in a different one of said channels, two pairs of arms, each pair having an upper arm and a lower arm extending between sidewalls of the cabinet and a different one of said slides;

means for producing rotation of each said pair of arms relative to the sidewalls whereby to raise and lower said first platform, a second platform, further means for supporting the second platform for vertical movement above and below said first platform, said further means including an eccentric mounting for said further means.

7. A computer console comprising:

a first platform;

a cabinet having sidewalls with vertical channels found therein and backwalls;

a pair of slides each secured to said first platform with each disposed for vertical movement in a different one of said channels, two pairs of arms, each pair having an upper arm and a lower arm extending between a backwall of the cabinet and a different one of said slides;

means for producing rotation of each said pair of arms relative to the backwall whereby to raise and lower said first platform, a second platform, further means for supporting the second platform for vertical movement above and below said first platform, said further means including an eccentric mounting for said further means.

8. A computer console according to claim 7 including means for tilting said second platform relative to the horizontal.

9. A computer console according to claim 7 further comprising means for adjusting the first platform to accommodate different weight loads said means for adjusting including means for connecting said means for producing rotation at different locations on said upper arm of each of said pair of arms.

10. A computer console according to claim 9 wherein said means for producing rotation comprises gas cylinders extending from said back wall of said cabinet to said one of said arms.

11. A computer console according to claim 10 further comprising means for locking said first platform in any position it can assume.

12. A computer console according to claim 9 wherein said means for adjusting includes gas cylinders having one end attached to a backwall of the cabinet and their other ends connected to said upper arms, means for changing the lengths of said upper arms from their points of attachment to said backwall to the point of attachment of said gas cylinders to said upper arms.

13. A computer console according to claim 7 wherein said eccentric mounting comprises an eccentrically mounted cylinder, said further means comprising a further pair of arms, said further pair of arms secured to said cylinder for rotation therewith and extending to and supporting said second platform.

14. A computer console according to claim 13 wherein said further pair of arms have a dog-leg shape.

15. A computer console according to claim 7 further comprising means preventing contact between said first and second platforms upon vertical movement of said second platform, said means including said eccentric mounting of said further means.

16. A computer console according to claim 15 wherein said means preventing contact further includes dog-leg arms extending from said eccentric mounting to said second platform.

17. A computer console comprising:

a first platform;

a cabinet having sidewalls with vertical channels found therein and walls;

a pair of slides each secured to said first platform with each disposed for vertical movement in a different one of said channels, two pairs of arms, each pair having an upper arm and a lower arm extending between a wall of the cabinet and a different one of said slides;

means for producing rotation of each said pair of arms relative to said wall whereby to raise and lower said first platform, a second platform, further means for supporting the second platform for vertical movement above and below said first platform, said further means including an eccentric mounting for said further means.

18. A computer console comprising:

a) a cabinet having sidewalls with vertical channels formed therein;

b) a first platform supported by the cabinet;

c) a pair of slides each secured to said first platform with each disposed for vertical movement in a different one of said channels;

d) multiple pivoting arms extending between a different sidewall of the cabinet at sidewall attachments and a different one of said slides;

e) and movably adjustable into multiple elevational positions as the arms are rotated about said sidewall attachments;

f) an extendable and retractable cylinder secured between said cabinet and an arm; and g) wherein the cylinder is valved between fixed and moving positions to enable a riser to secure the platform relative to the cabinet when the piston is in the fixed position and adjust the platform elevation relative to the cabinet when the piston is in the moving position.

* * * * *